US008059048B2

(12) United States Patent
Felstead et al.

(10) Patent No.: US 8,059,048 B2
(45) Date of Patent: Nov. 15, 2011

(54) ROTATING ANTENNA STEERING MOUNT

(75) Inventors: E. Barry Felstead, Kanata (CA); Stephen Montero, Manotick (CA)

(73) Assignee: Her Majesty the Queen in right of Canada, as represented by the Minister of Industry, Through the Communications Research Centre Canada, Ottawa (CA)

( * ) Notice: Subject to any disclaimer, the term of this patent is extended or adjusted under 35 U.S.C. 154(b) by 504 days.

(21) Appl. No.: 12/396,520

(22) Filed: Mar. 3, 2009

(65) Prior Publication Data

US 2009/0231224 A1 Sep. 17, 2009

Related U.S. Application Data

(60) Provisional application No. 61/035,584, filed on Mar. 11, 2008.

(51) Int. Cl.
*H01Q 3/00* (2006.01)

(52) U.S. Cl. ..... 343/766; 343/878

(58) Field of Classification Search ..... 343/765, 343/766, 878, 882, 840
See application file for complete search history.

(56) References Cited

U.S. PATENT DOCUMENTS 5,025,262 A * 6/1991 Abdelrazik et al. ..... 343/705
6,356,239 B1 * 3/2002 Carson ..... 343/765
6,911,950 B2 6/2005 Harron ..... 343/766

OTHER PUBLICATIONS

E. Barry Felstead, "Combining multiple sub-apertures for reduced-profile shipboard satcom-antenna panels", Proc. IEEE Milcom 2001, unclassified paper 19.6, Vienna VA, Oct. 28-31, 2001.

E. Barry Felstead, Jafar Shaker, M. Reza Chaharmir and Aldo Petosa, "Enhancing multiple-aperture Ka-band navy satcom antennas with electronic tracking and reflectarrays", Proc. IEEE Milcom 2002, paper U105.7, Anaheim CA, Oct. 8-10, 2002.

Corey Pike and Claude Desormeaux, "Ka-band land-mobile satellite communications using ACTS", 7th Ka-Band Utilization Conf., Sep. 2001.

Richard S. Wexler, D. Ho, and D.N. Jones, "Medium data rate (MDR) satellite communications on the move (SOTM) prototype terminal for the Army warfighters", Proc. IEEE Milcom 2005, Atlantic City, Oct. 17-20, 2005.

G. Maral and M. Bousquet, "Satellite Communications Systems: systems, Techniques and Technology", Fourth ed., by John Wiley & Sons, Chichester UK, 2002, pp. 392 to 394.

* cited by examiner

*Primary Examiner* — Tan Ho
(74) *Attorney, Agent, or Firm* — Teitelbaum & MacLean; Neil Teitelbaum; Doug MacLean

(57) ABSTRACT

An antenna steering mount includes two basic building blocks which are joined together to form any of the known steering-axis combinations. Each block includes a cylinder cut at an angle to form a cylindrical wedge. The wedges are joined together by bearings at their interface, and motors are used to counter rotate the two wedges relative to each other. One end of the complete assembly is attached to a mounting platform, and the other end includes mounting features for attaching an antenna dish thereto. Various two- and three-axis steering configurations are disclosed including combinations of azimuth, elevation, cross-elevation, and cross-level steering.

14 Claims, 14 Drawing Sheets

86
Feed
87
12
11
El axis
101
Post
14
Azimuth axis
Azimuth motor 24
101
Counterweights
Clear zone required by El motor
Support structure
a 86
Feed
87
Elevation arc
Support structure
Clear zone required by El motor
12
101
Counterweights
Post
Azimuth axis
29
Elevation axis
Azimuth motor 24
a
11

ROTATING ANTENNA STEERING MOUNT

CROSS-REFERENCE TO RELATED APPLICATIONS

The present invention claims priority from U.S. patent application Ser. No. 61/035,584 filed Mar. 11, 2008, which is incorporated herein by reference.

TECHNICAL FIELD

The present invention relates to a mount for an antenna, and in particular to a rotating two-part antenna mount with mating angled surfaces for steering the antenna in a desired direction.

BACKGROUND OF THE INVENTION

Conventional antenna mounts are normally required to mechanically steer high-gain antenna systems in two dimensions. In some mobile applications, such as ship-mounted antennas, the required steering range can be up to full hemispheric; however, in other applications, e.g. forward-looking radar antennas in the nose of aircraft, the steering range is limited to a narrower region. Similarly, multiple shipboard antennas, each with limited steering range, which in combination cover a large steering range, are disclosed in a paper by E. Barry Felstead, entitled "Combining multiple sub-apertures for reduced-profile shipboard satcom-antenna panels," in Proc. IEEE Milcom 2001, unclassified paper 19.6, Vienna, Va., 28-31 Oct. 2001; and in a paper by E. Barry Felstead, Jafar Shaker, M. Reza Chaharmir and Aldo Petosa, entitled "Enhancing multiple-aperture Ka-band navy satcom antennas with electronic tracking and reflectarrays," in Proc. IEEE Milcom 2002, paper U105.7, Anaheim, Calif., 8-10 Oct. 2002.

Regardless of the application, the steerable antenna mounts are preferably made as compact as possible by minimizing the size of the motors, and the profile depth, mass, and volume of the combined antenna and mounting structure. Moreover, it is also desirable to make the antenna mounts relatively simple and inexpensive to build.

Steering or pointing of the antenna involves a rotation about a single axis or about a plurality of axes, e.g. a variety of different axes used in various combinations depending upon the application of the antenna. Typically, the basic axes are referred to as azimuth, elevation, cross-elevation, and cross-level, as is well known in the art. Driving motors are usually used for actuating the rotation about the different axes. The different axes can be coupled together in a variety of ways including the use of gimbals.

With reference to FIG. 1, for discussion purposes, the reference coordinates are $(x_r, y_r, z_r)$ with the antenna system located at (0, 0, 0). The zenith is considered to be in the direction of the $z_r$ axis, and the $x_r$ and $y_r$ coordinates lie in the horizontal plane. For mobile applications, the $y_r$ axis could be pointed in the direction of forward motion. Spherical coordinates $(\phi,\theta,\rho)$ are also illustrated in FIG. 1, in which the angle $\phi$ corresponds to the azimuth angle, and the angle $\theta$ corresponds to the complement of the elevation angle, $\epsilon$, i.e. $\epsilon=90°-\theta$.

With reference to FIG. 2(*a*), a common two-axis antenna mount is an elevation-over-azimuth mount 1 for antenna 2, which uses a first motor (not shown) providing up to full azimuth rotation (360°) about a vertical axis V, and a second motor (not shown) providing full elevation rotation (90°) about a horizontal axis H. The center of gravity of the antenna 2 is usually offset from the pivot points, thereby requiring that the first and second motors have increased torque. These disadvantages can be reduced in certain applications in which the elevation range of the antenna is more limited, such as with the KVH series of satellite-dish antennas. Corey Pike and Claude Desormeaux, disclosed the adaptation of a type G3 KVH antenna for a vehicle-mounted application in the reference entitled "Ka-band land-mobile satellite communications using ACTS", 7th Ka-Band Utilization Conf., September 2001, and Richard S. Wexler, D. Ho, and D. N. Jones, disclosed the adaptation of a type G6 by MITRE in the reference entitled "Medium data rate (MDR) satellite communications on the move (SOTM) prototype terminal for the Army warfighters," in Proc. IEEE Milcom 2005, Atlantic City, Oct. 17-20, 2005. Unfortunately, the elevation-over-azimuth mount also has problems with cable wrap and with the keyhole effect in the zenith direction, as will be discussed later.

A less-common type of mount is the cross-elevation-over-elevation mount 5, as illustrated in FIG. 2(*b*), sometimes referred to as an "X-Y" mount. An elevation motor (not shown) is used to rotate an antenna 6 about a first horizontal elevation axis, and a cross-elevation motor (not shown) is used to rotate the antenna 6 about a cross-elevation axis. The mass of both the antenna 6, and the cross-elevation motor must be supported by the elevation motor, thereby adding to the motor-torque requirements; however, the X-Y mount does not have a keyhole problem in the zenith direction and does not have a cable wrap problem. Unfortunately, the X-Y mount tends to have a reduced steering range compared to the elevation-over-azimuth mount.

In certain applications, such as on naval ships, a third axis of steering is sometimes added to the antenna mount to get around the keyhole problem that the standard azimuth-elevation mount exhibits in the zenith direction. Another purpose is to add what is sometimes called a "cross-level" axis to simplify the compensation for ship roll and pitch.

An alternative approach to antenna steering is disclosed in U.S. Pat. No. 6,911,950 issued Jun. 28, 2005 to Harron, referred to as the "universal-joint gimbaled antenna mount" (or the "GiAnt" mount). As illustrated in FIG. 3, the antenna 7 plus the feed system is placed so that the center of mass is at, or near, the center of the universal joint 8, such as a ball joint. A yoke 9 driven by a motor (Motor 2) scans the antenna 7 about the elevation axis EA, and another motor (Motor 1) mounted on the yoke 9 pivots the antenna 7 about the ends of the yoke 9, i.e. scans the antenna 7 about the cross-elevation axis XEA. Since the center of mass of the system rests on the ball joint 8, the motors (Motor 1 and Motor 2) can be very small, i.e. small digitally driven stepper motors with built in shaft encoders can be use. Such a system can scan to over ±50° in both elevation and cross elevation, and with careful mechanical design could be slightly extend. As a result of the "X-Y" form of scanning, there is no problem with cable wrap, and the keyhole has been pushed far from boresight. Moreover, the GiAnt mounting system is relatively inexpensive to manufacture.

Unfortunately, the GiAnt mounting structure exhibits vibration in the form of twisting of the yoke 9 when mounted on a platform undergoing severe movements, e.g. ship mounted. The yoke 9 could be strengthened, but difficulties arise when making it sufficiently rigid for the steering accuracies likely to be encountered.

Rotating-wedges were disclosed by G. Maral and M. Bousquet, in *Satellite Communications Systems: systems, Techniques and Technology*, Fourth ed., by John Wiley & Sons, Chichester UK, 2002, pages 392 to 394, for supplementing a standard steering system to give a slight offset "bias", which is used to avoid the keyhole problem, but were not intended to be used as the means of steering in one of the major axes.

An object of the present invention is to overcome the shortcomings of the prior art by providing an antenna steering mount comprised of two counter-rotating wedged bodies.

SUMMARY OF THE INVENTION

Accordingly, the present invention relates to an antenna mount comprising:

abase;

a first bearing structure supported by the base;

a first wedge-shaped body having a first end mounted on the first bearing structure and a second end at a first acute wedge angle to the first end;

a second bearing structure mounted on the second end of the first wedge-shaped body;

a second wedge-shaped body mounted on the second bearing structure, having a first end parallel to the second end of the first wedge-shaped body and a second end at a second acute wedge angle to the first end of the second wedge-shaped body;

a first motor for rotating the first wedge-shaped body relative to the base; and a second motor for rotating the second wedge-shaped body relative to the first wedge-shaped body.

BRIEF DESCRIPTION OF THE DRAWINGS

The invention will be described in greater detail with reference to the accompanying drawings which represent preferred embodiments thereof, wherein.

DETAILED DESCRIPTION

Figure 4:
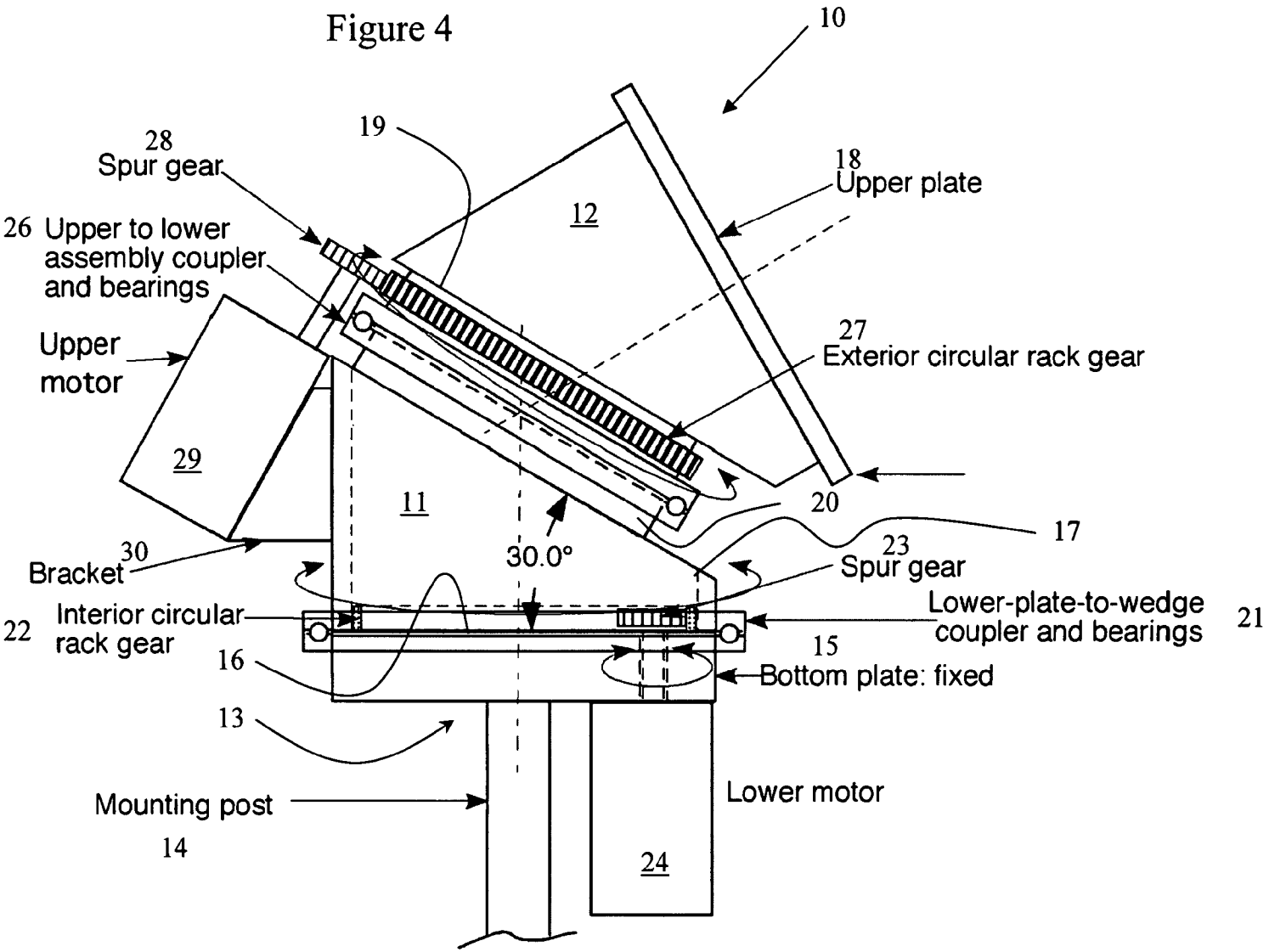
FIG. 4 is a side view of an antenna mount in accordance with the present invention.

With reference to FIG. 4, an antenna mount 10 in accordance with the present invention includes two rotating wedges, e.g. wedge-shaped blocks or bodies, from which the various forms of antenna steering can be implemented. In the preferred embodiment the two wedge-shaped bodies are comprised of two cylindrical wedges 11 and 12, with the first cylindrical wedge 11 rotatably mounted on a mounting structure 13, and the second cylindrical wedge 12 rotatably mounted on the first cylindrical wedge 11. The first and second wedges 11 and 12, respectively, are preferably cylindrical; however, any other shapes are within the scope of the invention.

In the illustrated embodiment, the mounting structure 13 is comprised of a mounting post 14 and a bottom plate 15 fixed on the end of the mounting post 14; however, other structures are within the scope of the invention. The first cylindrical wedge 11 is defined by a base 16 mounted for rotation on the mounting structure 13, and an upper surface 17 with a flange 20 at a first acute wedge angle to the base 16. The second cylindrical wedge 12 is defined by an upper mounting plate 18, and a lower surface 19 parallel to the upper surface 17. The upper mounting plate 18 is at a second acute wedge angle to the lower surface 19.

A first bearing structure 21, e.g. a ring of ball bearings between corresponding bearing surfaces, is disposed at the interface between the first wedge 11 and the mounting structure 13 to enable free rotation therebetween. A gear set is used to drive the first wedge 11 relative to the mounting structure 13, e.g. a 360° ring gear 22 with teeth extending diametrically inwardly thereof fixed to the base 16 is rotated by a spur gear 23, which is driven by a first or lower motor 24. The first wedge 11 is rotatable about a first axis perpendicular to the base 16, the first axis being the same as the central longitudinal axis of the first wedge 11. However, the second wedge 12 is rotatable about a second axis perpendicular to the lower surface 19 thereof and the upper surface 17 of the first wedge 11, which is not the longitudinal axis of the second wedge, but at an acute angle, e.g. the wedge angle, thereto.

Figure 5:
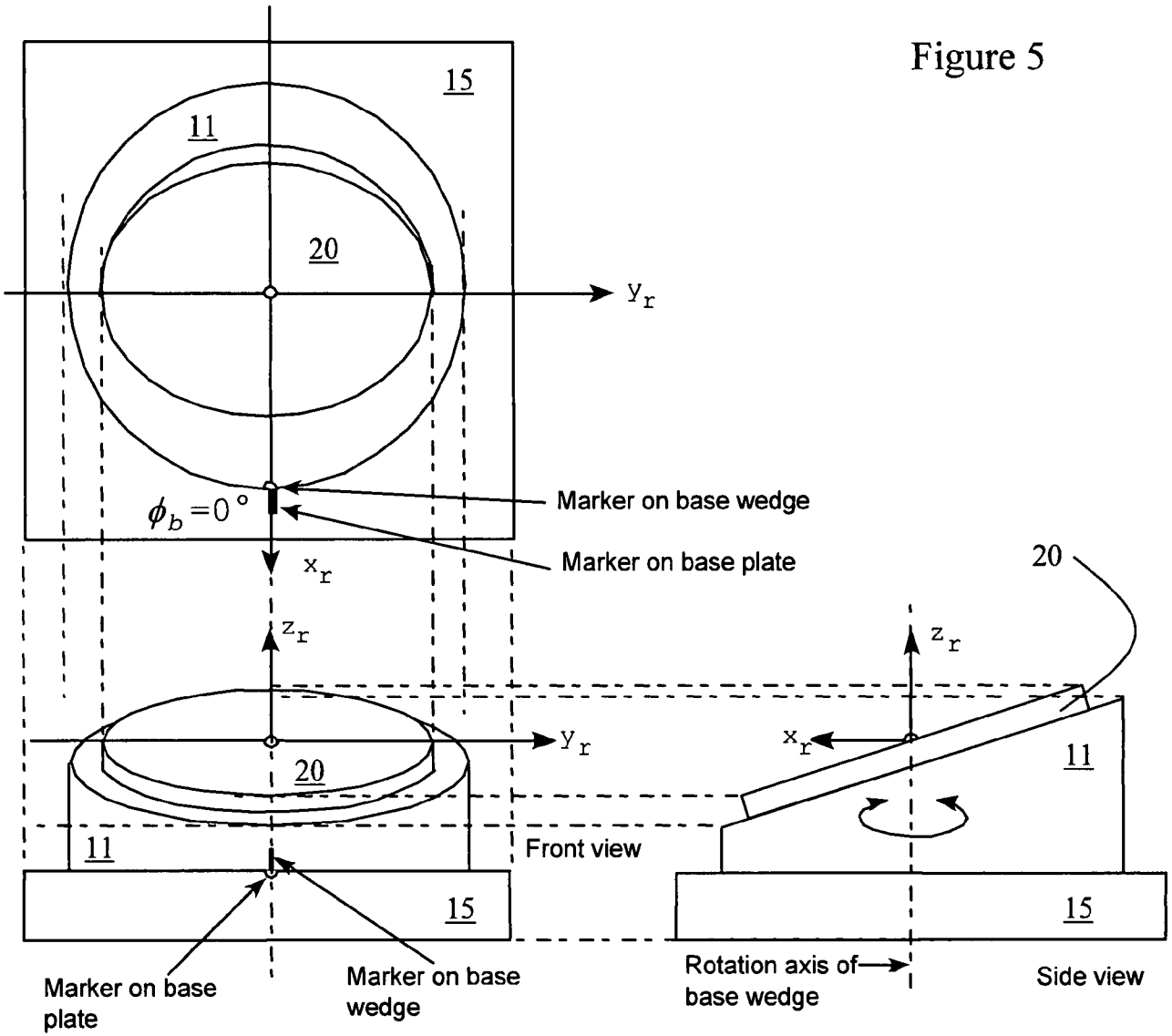
FIG. 5 illustrates front, side and top views of the base wedge-shaped body of the antenna mount of FIG. 4.

In the illustrated embodiment, the base plate 15 is mounted horizontally on the earth; however, in practice, the base plate 15 can be mounted in any orientation. With reference to FIG. 5, the reference axes, $(x_r, y_r, z_r)$, are centered in the middle of the base circular flange 20. The $z_r$ axis points vertically and the $x_r$ axis is horizontal and in the plane that contains the $z_r$ axis and cuts through the first wedge 11 between its lowest and highest part. The positive direction of the $x_r$ axis is toward the small end of the first wedge 11. The base plate 15 is shown as square so that it can more easily be distinguished from the first wedge 11.

Similarly, a second bearing structure 26, such as seen in FIG. 4, e.g. a ring of ball bearings between corresponding bearing surfaces, is disposed at the interface between the first wedge 11 and the second wedge 12 to enable free rotation therebetween. A 360° circular rack gear 27 with teeth extending diametrically outwardly is mounted on the lower surface 19 of the second wedge 12, for engaging a spur gear 28, which is driven by a second or upper motor 29 mounted on the first wedge 11 via bracket 30.

Figure 1:
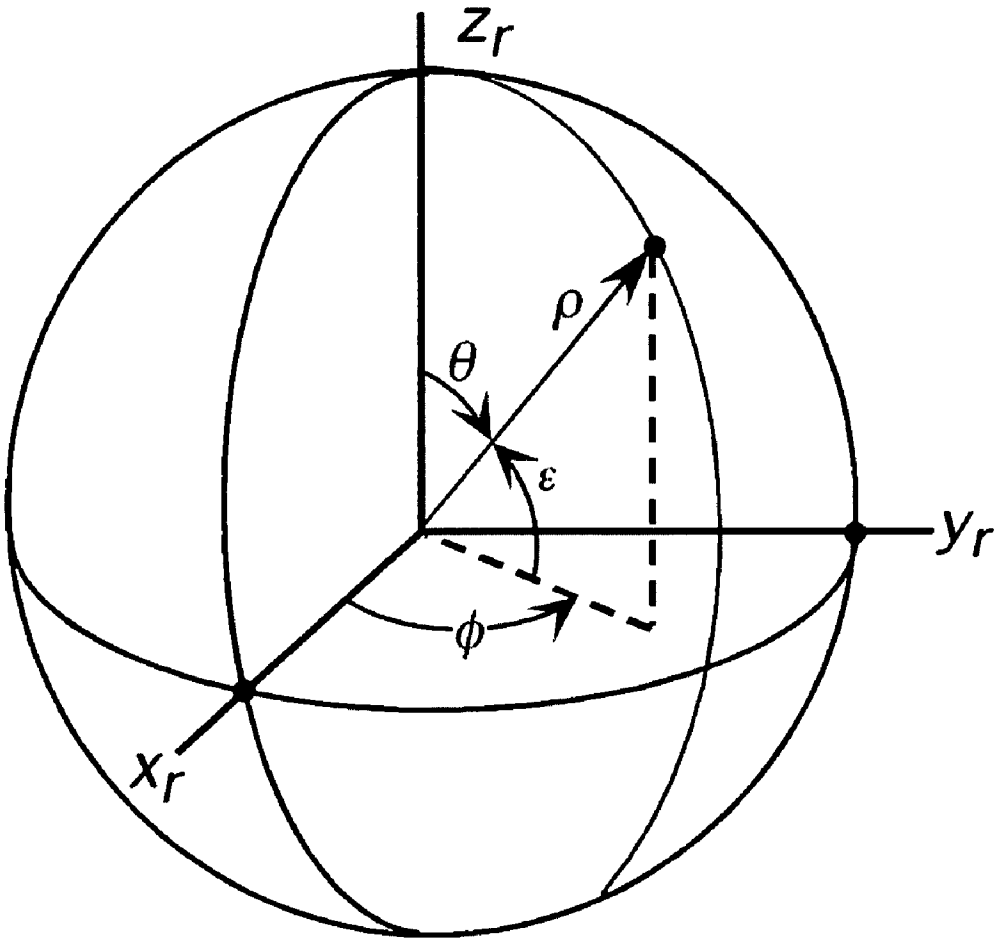
FIG. 1 illustrates the reference coordinates for an antenna steering mount.
Figure 2:
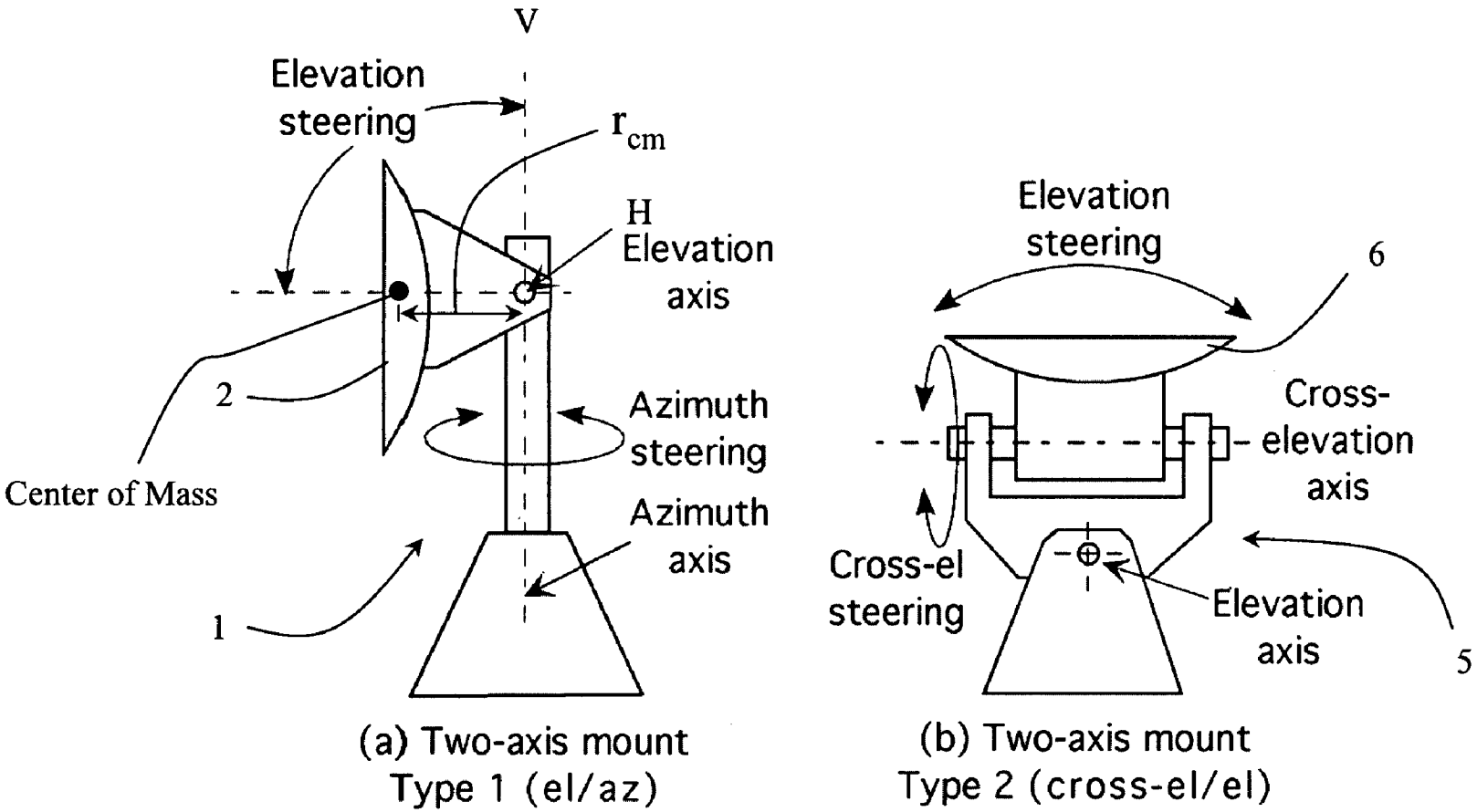
Figure 2 Prior Art
FIGS. 2*a* and 2*b* are schematic diagrams of conventional antenna steering mounts.
Figure 3:
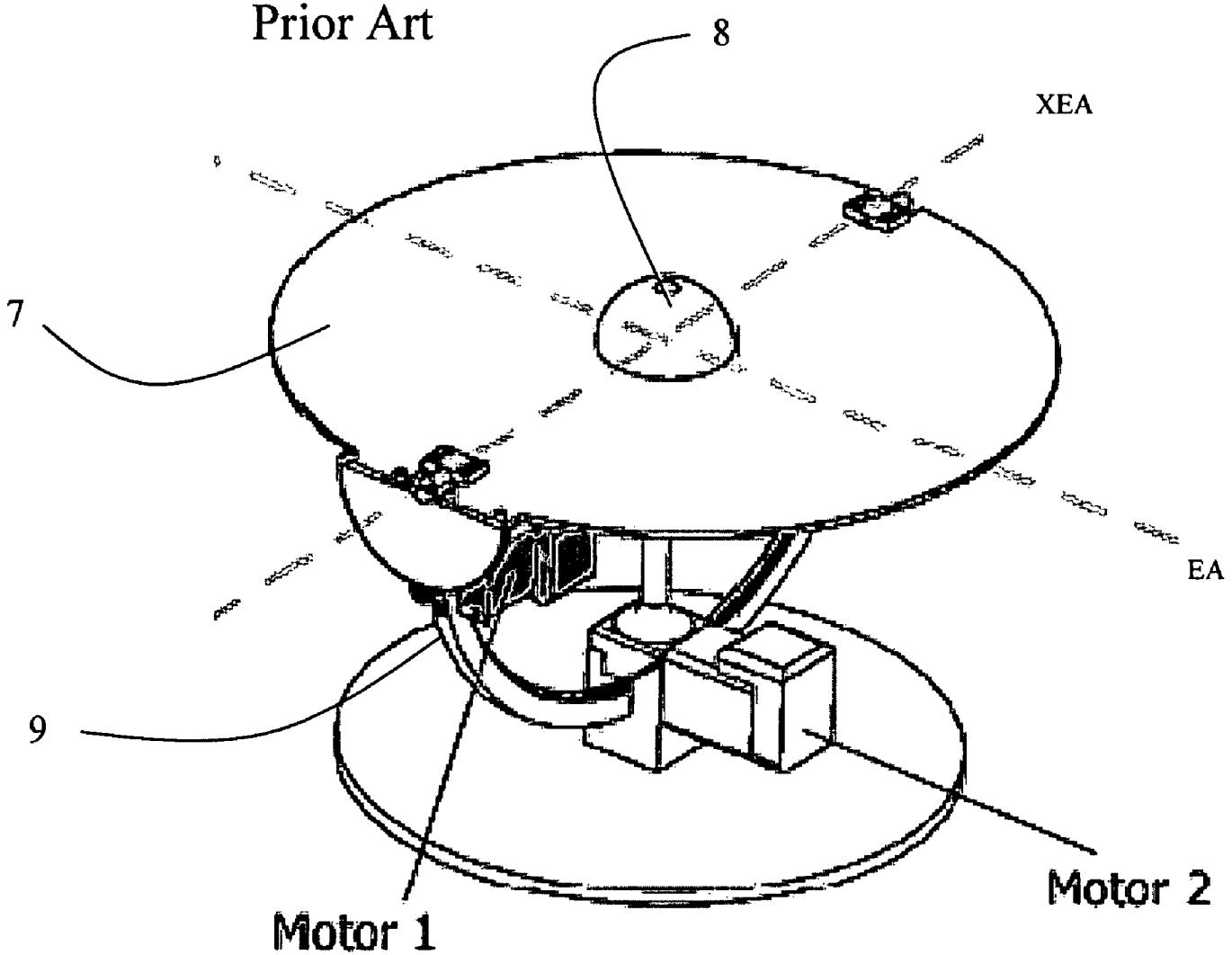
Figure 3 Prior Art
FIG. 3 illustrates another prior art antenna steering mount.

The upper mounting plate 18 includes suitable fasteners for mounting an antenna dish or flat reflect array, as is well known in the art. Rotation of the first and second wedges 11 and 12 causes tilting of the upper mounting plate 18, so as to steer the antenna in a motion like that of the elevation motors in FIGS. 2(*a*) and 2(*b*). The rotating-wedges 11 and 12 can be viewed as a replacement for the commonly used rotating axes or gimbals. For example, such a wedge pair 11 and 12 can be used to replace the elevation steering device in an elevation-over-azimuth configuration. In another example, the two wedges 11 and 12 can be used to replace the elevation and the cross-elevation units for the cross-elevation-over-elevation configuration. The two relatively rotating wedges 11 and 12 can be combined inline in various combinations of steering operations.

The objective of the rotating wedge antenna mount in accordance with the present invention is to point an antenna over a two-dimensional region; accordingly, it is necessary to convert the desired pointing direction, such as azimuth, elevation and cross elevation, into the relative rotation angles of the various rotating-wedge, and rotating-plate blocks.

The differential angle between the second wedge 12 and the first wedge 11 gives the elevation angle. To change the elevation without changing the azimuth, the lower and upper motors 24 and 29, respectively, must rotate by an equal angle but in the opposite direction. To change the azimuth angle alone, the upper motor 29 is used to lock the first wedge 11 to the second wedge 12, and the lower motor 24 rotates the combined wedges 11 and 12, so as to steer to the new azimuth angle. For the second wedge 12, the upper motor 29 causes the two wedges 11 and 12 to rotate differentially giving the elevation scanning. For elevation scanning with fixed azimuth scanning, the first wedge 11 must rotate equally and oppositely to the rotation of the second wedge 12. For combined azimuth and elevation scanning, both lower and upper motors 24 and 29 must be operated.

In the illustrated embodiment in FIG. 4, the maximum wedge angle, $\alpha_{max}$, is chosen as 30°, whereby the elevation-complement scan range is ±60°. A range of maximum wedge angles are within the scope of the invention, e.g. when both wedges 11 and 12 have a wedge angle, $\alpha_{max}$, of 45° the elevation scan can go from 90° (straight up) to 0° (pointing horizontally as seen in 6). Typically, when the wedge angles for both the first and second wedges 11 and 12 are the same, the wedge angles, $\alpha_{max}$, ideally vary between 20° and 45°; however, when the wedge angles are different, the range of wedge angles can vary between 20° and 70°, and typically add up to between 40° and 90°. The range in azimuth is 360°.

For optimum operation, the central longitudinal axis of the first wedge 11, shown as a dashed line in 4, should intersect the central longitudinal axis of the second wedge 12 at the center of the interface of the second bearing 26. Otherwise the second wedge 12 will experience an undesired mutation.

In the antenna mount described above, the lower motor 24 does a combined action for both elevation and azimuth steering. In alternative embodiments, illustrated in FIG. 6, the azimuth and elevation steering is decoupled using a three-motor configuration, including a first (or bottom) wedge 31, a second (or middle) wedge 32, and a third (or top) wedge 33, or a four-motor configuration, which also includes a fourth wedge 34. The mounting structure 13, including the mounting post 14 and the bottom plate 15 can be identical to those hereinbefore described with reference to FIG. 4. Similarly, the first wedge 31 can be rotatably mounted on the mounting structure 13 utilizing the first bearing structure 21, and rotated utilizing the first (lower) motor 24 driving the spur gear 23 and the ring gear 22, mounted on the bottom of the first wedge 31. The second wedge 32 can be rotatably mounted on the first wedge 31 utilizing the second bearing structure 26, and rotated utilizing the second upper motor 29 driving the spur gear 28 and the circular rack gear 27. The third wedge 33 is mounted on the second wedge 32 utilizing a third bearing structure 36, as hereinbefore defined. A third motor 37, mounted on the second wedge 32 drives a third spur gear 38 on an upper circular rack gear 39, which extends from around the bottom of the third wedge 33. The third wedge 33 is rotated about an axis perpendicular to one end of the third wedge 33, which is also the longitudinal axis thereof.

If necessary, the fourth wedge 34 can be mounted on the third wedge 33 utilizing a fourth bearing structure 41, similar to those hereinbefore described, and rotated by a fourth motor 42, which drives a fourth spur gear 43 on a top circular rack gear (not shown) extending from around the bottom of the fourth wedge 34. The fourth wedge 34 is rotated about an axis perpendicular to one end of the fourth wedge 34 adjacent to the outer end of the third wedge 33, which is at an acute angle to the longitudinal axis thereof.

The second and third motors 29 and 37 of the middle and top wedges 32 and 33, perform elevation steering only. The azimuth steering could be performed by rotating the first wedge 31 or simply by rotating the mounting post 14. The advantage of the three or four-motor systems over the two-motor systems is that the controls for driving the azimuth and elevation axes are decoupled enabling simpler control systems to be developed.

For applications in which the requirement of scanning is over a relatively small two-dimensional angular range centered on a particular direction, e.g. radar antenna in the nose of an airplane, steering of the antenna mounts can be performed using a cross-elevation-over elevation configuration.

Figure 6:
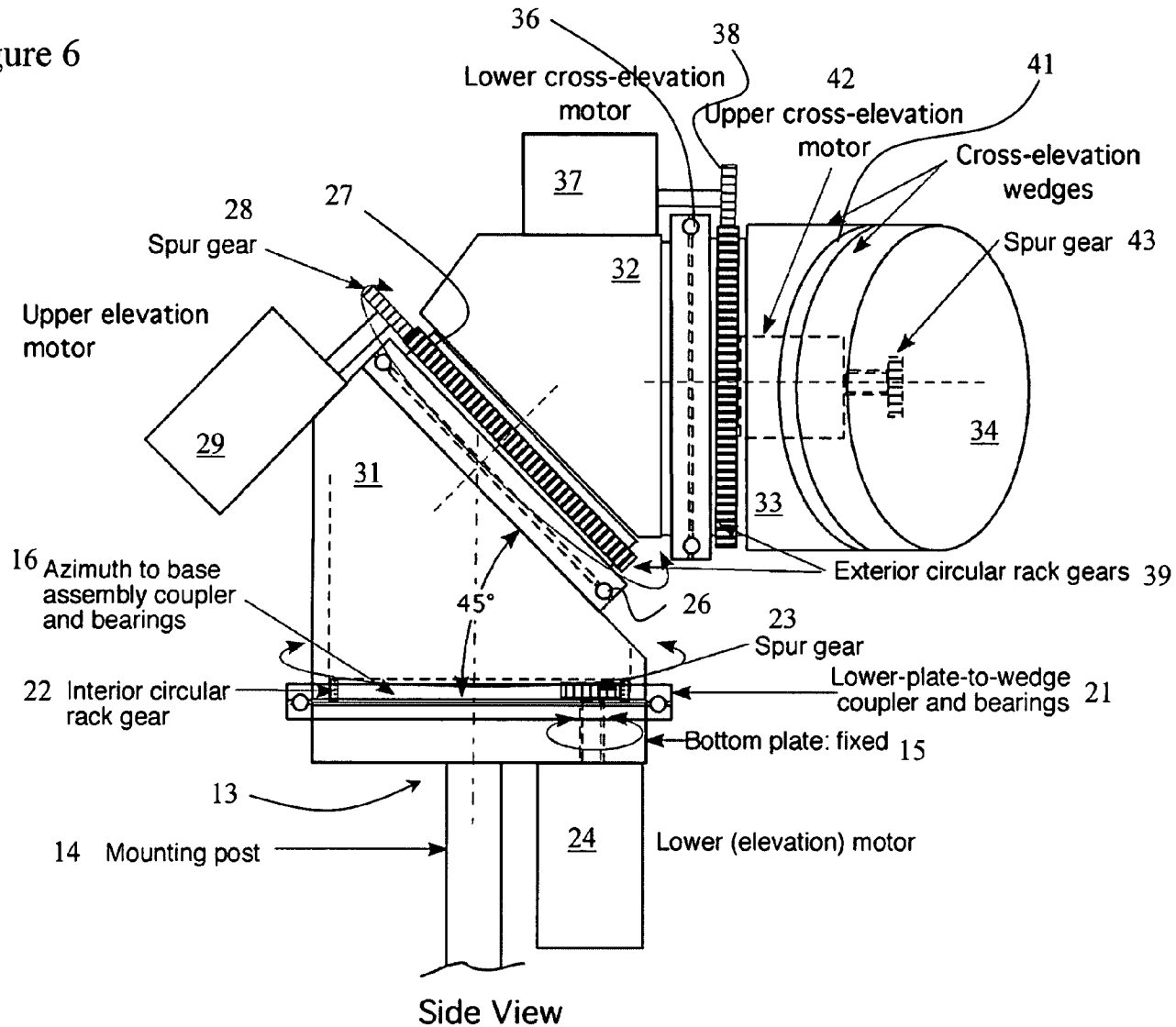
FIG. 6 is a side view of an antenna mount in accordance with another embodiment of the present invention with up to four wedge-shaped bodies.

Cross-elevation-over-elevation steering can be implemented with the four-wedge system illustrated in FIG. 6, which includes two complementary pairs of rotating-wedge blocks 31/32 and 33/34 rotatable on the mounting structure 13. The lower pair of wedges 31/32 performs elevation steering, while the upper wedge pair 33/34 performs the cross-elevation steering, and is therefore oriented so that the plane of scanning of the upper pair of wedges 33/34 is at 90° (orthogonal) to the scanning plane of the lower pair of wedges 31/32. The fourth (cross-elevation) motor 42 (shown in dashed lines) is hidden behind the third and fourth wedges 33 and 34. Both the elevation wedges 31/32 and the cross-elevation wedges 33/34 were chosen for the example in 5 to have wedge angles of $\alpha_{max}$=45°; however, other wedge angles are within the scope of the invention, as hereinbefore described.

Figure 7:
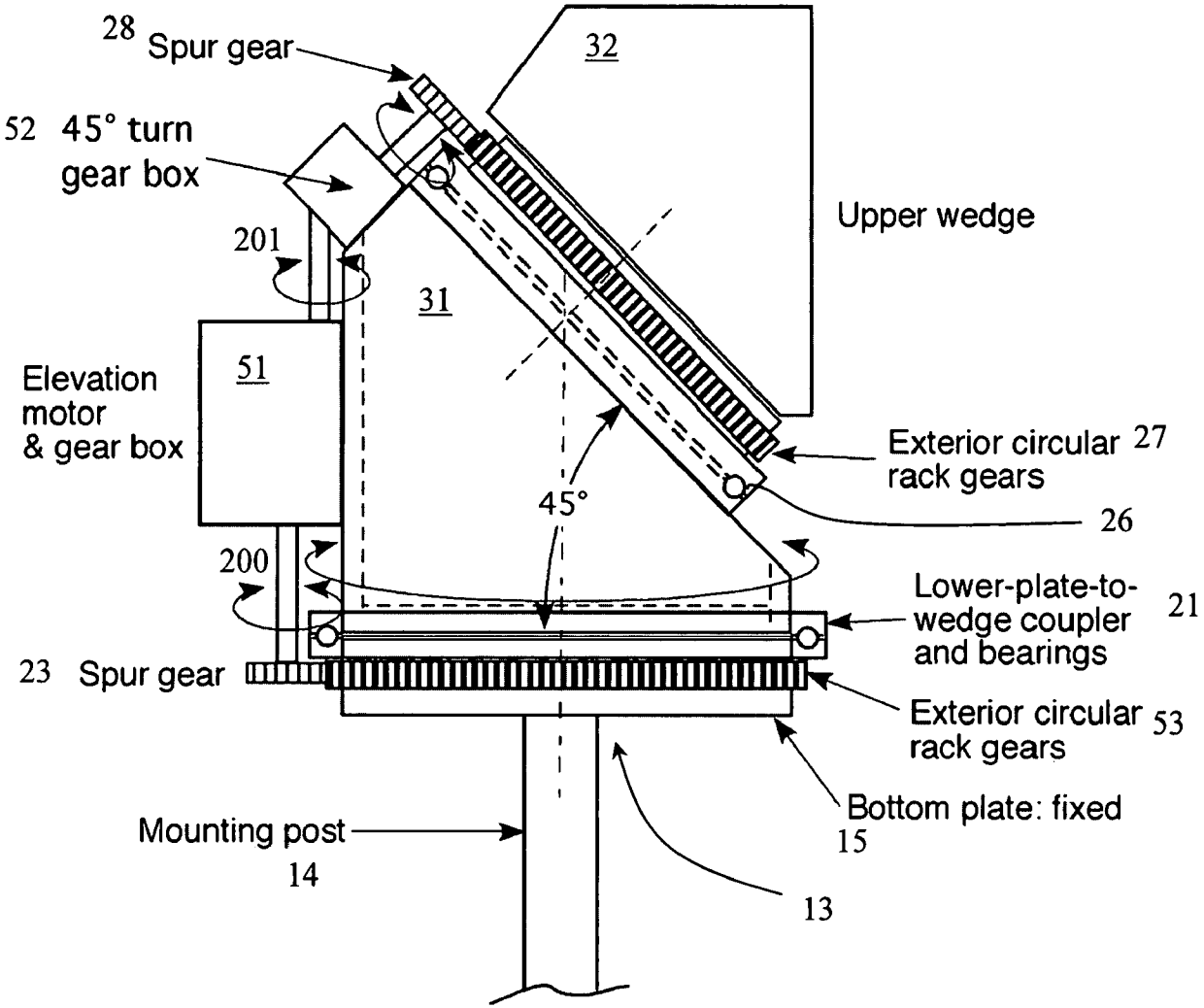
FIG. 7 is a side view of a portion of an antenna mount in accordance with a modification of the embodiment of FIG. 6.

With reference to FIG. 7, it is possible to implement the cross-elevation-over-elevation configuration of FIG. 6 with only two motors, e.g. a first elevation motor 51, with two drive shafts, 200 and 201 for the elevation wedge pair 31/32, and a second cross-elevation motor (not shown) for the cross-elevation wedge pair 33/34. The first elevation motor 51 drives both the first and second spur gears 23 and 28, simultaneously, either directly, as with the first spur gear 23, or indirectly via an angled gear box 52. In this embodiment, the ring gear 22 is replaced by another rack gear 53 extending from around the bottom of the first wedge 31. The lower drive shaft 200 drives the first spur gear 23, which rotates the wedge 31 about an axis perpendicular to the base plate 15, while the upper drive shaft 201 drives the second spur gear 28 through a 45° turn gear box. For the wedge angle of 45° used in this example, the shaft angle must also be turned by 45°. The gearing of the gear box 52 must be such that the rotation angle of the second wedge 32 is exactly equal to in magnitude, but opposite to in direction, the rotation angle of the first wedge 31.

In the embodiments illustrated in FIGS. 4 and 6, the scan range in both angular directions can be sufficiently small that elevation-over-azimuth steering can be operated in an approximation to a cross-elevation-over-elevation format. The usual elevation range for the two-wedge system is for $\theta=0°$ to $2\alpha_{max}$, $\alpha_{max}$ being the wedge angle. However, in the region around $\theta=\alpha_{max}$, i.e. in the center of the elevation steering range, the azimuth and elevation steering are approximately orthogonal. Therefore, X-Y (cross-elevation-over-elevation) steering can be achieved with the two-wedge mount 10 illustrated in FIG. 4 via an elevation-over-azimuth system operating within a certain angular range around this central direction. The range can be extended by conversion of the desired cross-elevation-over-elevation coordinates to values of rotation of the wedges.

Figure 8:
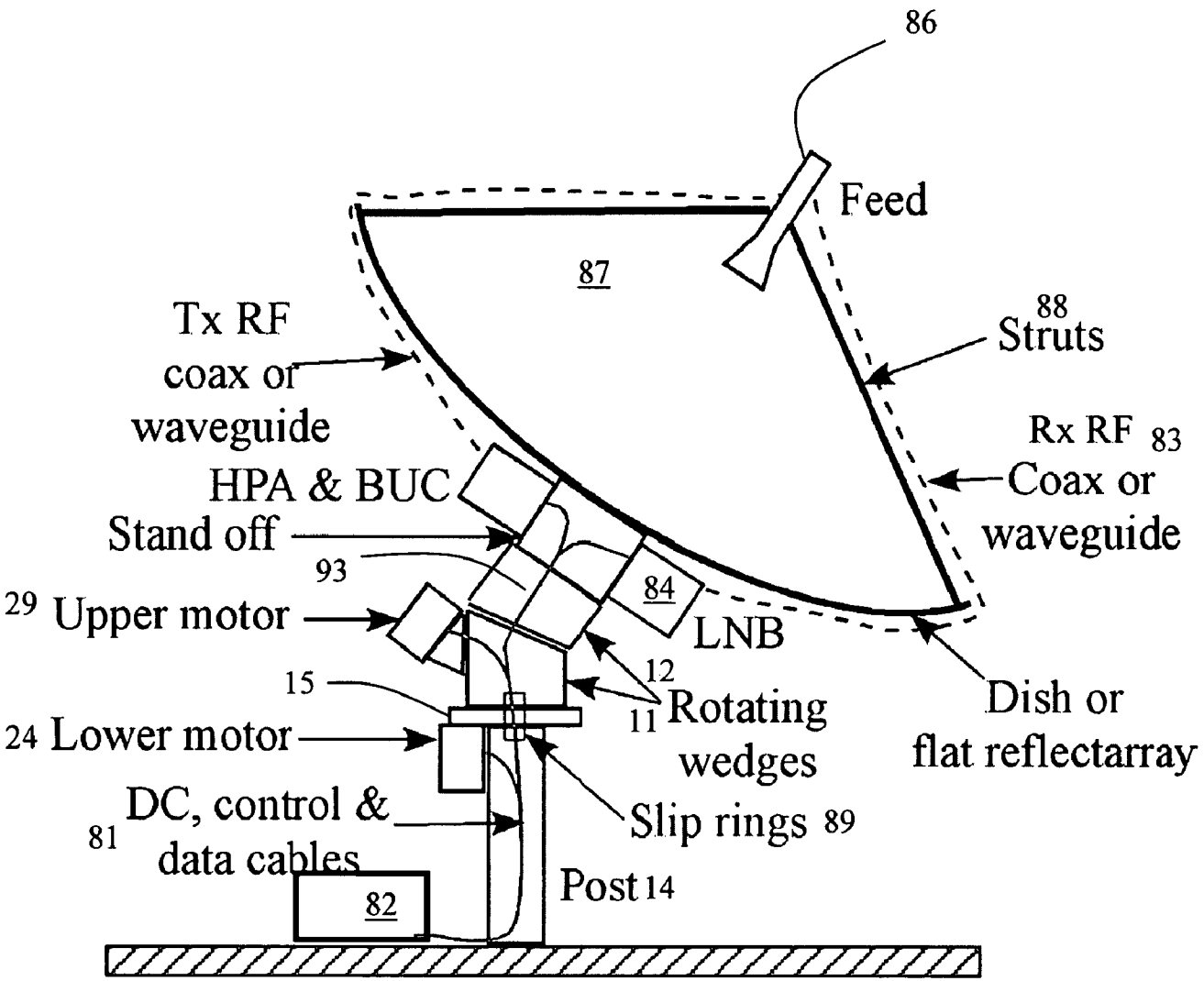
FIG. 8 is a schematic diagram of the antenna mount of FIG. 4 with an antenna mounted thereon illustrating the transmission of power and data signals.
Figure 9:
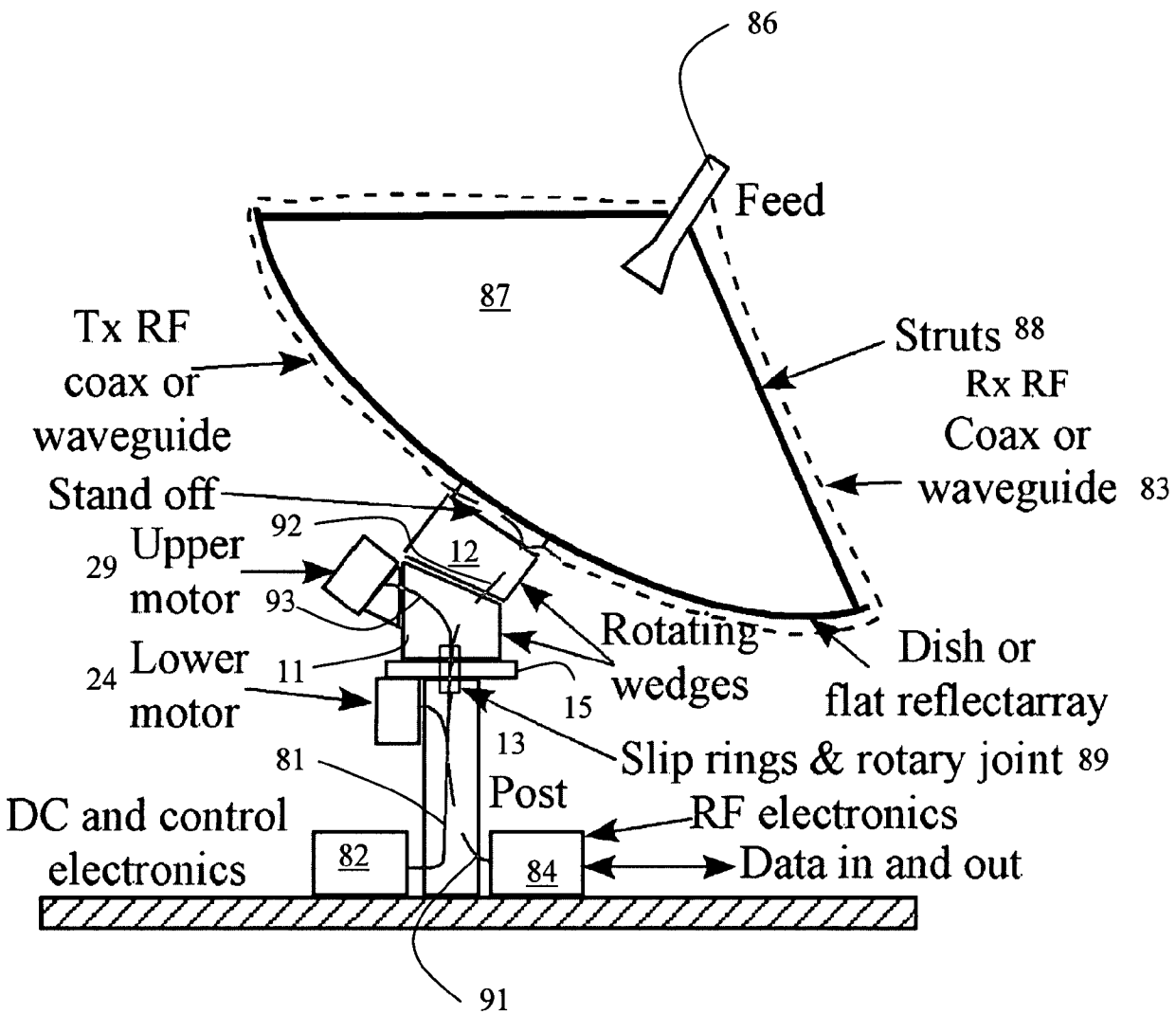
FIG. 9 is a schematic diagram of the antenna mount of FIG. 4 with an antenna mounted thereon illustrating an alternative path for the transmission of power and data signals.

With reference to FIGS. 8 and 9, a first cable 81 is required to transmit DC power and motor control signals between the two (or more) motors 24 and 29 and a electrical control box 82 disposed adjacent to the antenna support structure 13 or some other remote location. Moreover, a second cable 83 is required to transmit data, e.g. RF signals between RF control boxes 84 and an antenna feed 86 extending from an antenna 87 mounted on the mount 10.

In the illustrated embodiments, the antenna 87 is a dish antenna with a direct feed 86 held by struts 88; however, various other forms can be used including a Cassegrain system with a secondary reflector, and a flat reflectarray in place of the dish. The RF cables 83 between the feed 86 and the cable 92 or the RF control boxes 84, e.g. the high power amplifier (HPA) and the low-noise block converter (LNB), are fixed to the dish 87 as illustrated in small dashed lines in FIGS. 8 and 9, and can be either co-axial cable or waveguide.

In FIG. 8, the data control boxes 84, such as the HPA, block up converter (BUC), and LNB, are located at the back of the antenna 87. The data signals are then carried to and from the feed 86 by means of the second cable 83, e.g. coaxial cable or waveguide, fixed in some manner to the dish 87 and struts 88. In FIG. 9, the data control boxes 84 are placed at the base of the mounting structure 13 or some other remote location, and must be connected to the fixed coaxial cable 83 or waveguide at the dish 87 via a third and fourth connector cables 91 and 92, which extend down through the mount 10.

For both layouts, the DC power and motor control distribution is the same. The distribution of power and control signals is relatively simple for the first motor 24, since it is fixed relative to the mounting structure 13. However, the second motor 28 rotates with the first wedge 11, as it performs the azimuth steering. Such rotation can cause the first cable 81 to have unacceptable amounts of twist. In a preferred embodiment, the twisting is eliminated with the use of an electrical slip-ring 89 device placed at the center of the interface between the bottom plate 15 and the first wedge 11. Slip rings 89 are relatively inexpensive and can be obtained "off-the-shelf." Note that the cables 93 coming out of the top of the slip ring 89 rotate with the first wedge 11 and do not flex.

The term "slip ring" might also be called by a variety of other names including "electrical rotary joint", etc. We use the term "slip ring" here to apply to DC or low frequency control signal applications. It may also be possible to put data through slip rings if the data rate is sufficiently low. The term "rotary joint" is hereinafter used to apply to joints that handle IF or RF data signals.

The distribution of the RF and data signals is more complex than for the DC and motor control. With reference to FIG. 8, the DC power and the data transfer must be brought from the electrical control box 82 to the RF control box 84 at the back of the antenna 87 via the cables 81 and 93, which branches off from the cables running to the first and second motors 24 and 29. Note that the cables 93 from the first wedge 11 that split off to the back of the antenna 87 do not twist so that there is no wire-wrap problem. Instead, the cables 93 flex as the mount 10 steers in elevation, because the first and second wedges 11 and 12 rotate equally but oppositely, so that there is no net rotation (twist) of the cables 93.

In FIG. 9, the RF control boxes 84 are mounted at the base of the mounting structure 13 or some other remote location so that RF power has to be carried to and from the back of the antenna 87. In this configuration, there is no need for separate lines to transfer data. The RF cables 91 and 92 are shown in long-dashed lines in FIG. 9. In order to bring the RF line 91 from the RF control boxes 84 through the first wedge 11, it is necessary to minimize the effects of the azimuth rotation of the first wedge 11 to prevent the RF line 91 from twisting. A commercial rotary joint 89 can be used for this transition; however, it is possible to have both a rotary joint 89 within a slip-ring assembly, whereby the DC and control electronics for the upper motor 29 and the RF line 91 can be simultaneously accommodated.

The cable 92 between the rotary joint 89 and the cables 83 fixed to the antenna 87 is a flexible cable, which only flexes back and forth, without twisting, as the elevation steering is performed. Both transmit and a receive data, e.g. RF, signals can be accommodated on a single line, if some form of isolator is provided the back of the antenna 87, where the cable 92 splits between transmit and receive.

Alternatively, the data control boxes 84 are placed on top of the mount 10, and connected to the antenna 87 by a flexible cable 83. The DC power is provided to the control boxes 84 and the motors 24 and 29 through slip ring 89, while the data is transferred between the a remote source and the data control boxes 84 by an inexpensive commercial off-the-shelf computer wireless link.

In mechanical steering of antennas, there can arise a condition, called the "keyhole effect", which requires a very large steering angle change for a relatively small angular change in the satellite direction. For example, in a steering system that uses elevation-over-azimuth pointing in which the elevation angle, $\epsilon$, is close to 90°, i.e. pointing to the nadir, and the platform, such as on a ship, has a small roll or pitch that is at 90° to the elevation arc, it would be necessary for the azimuth steering to be changed by 90° very rapidly thereby requiring very large angular accelerations.

For the elevation-over-azimuth steering with the rotating wedge antenna mount in accordance with the present invention, the keyhole problem can be eliminated by replacing the top plate 18 by a wedge-shaped mounting plate oriented so as to rotate the beam pointing by a small amount, $\Delta\epsilon$, along the elevation direction. The wedge angle of the wedge-shaped mounting plate would be relatively small, typically in the order of about 5° to 15°, preferably 10°. If the original range of elevation scanning was, 0° to 90°, then the new range is from $\Delta\epsilon$ to $90°+\Delta\epsilon$. The keyhole would be shifted to $\epsilon=90°+\Delta\epsilon$ where it would be out of the range of operation. The addition of the wedge-shaped mounting plate would require a more complex algorithm for computing the required wedge-rotation angles.

For the cross-elevation-over-elevation (X-Y) configuration, the keyhole has been shifted from the zenith location down to the 0° elevation location. Therefore, the X-Y configuration can be operated over all of a hemisphere except near 0° elevation. In this region of operation, a third steering axis could be added to eliminate this problem.

The size of the first and second motors 24 and 29 depends upon the torque required. The motor torque overcomes two forces: the first force is the static holding force of gravity exerted on the center of mass of the antenna 87; the second force arises from angular acceleration of the center of mass of the antenna 87. The antenna 87 undergoes two angular accelerations: the first is the angular acceleration needed to steer the antenna 87 to a new position; and the second is the angular acceleration arising from motion of the mounting structure 13, such as would be experienced on a ship. The force needed to overcome bearing friction is usually low relative to the other forces.

The following analysis relates to the torque requirements for an elevation-over-azimuth mount in relation to the static force of gravity. Moreover, the analysis concentrated on an assembly mounted with a horizontal base plate, such as is shown in FIG. 2*a*. For other mounting angles, the analysis would have to be correspondingly changed; however, the range of values of torque factor (to be defined) would be no larger.

The torque required by the antenna mount 10 to support the mass of antenna 87 is compared to that required by the standard elevation-over-azimuth system, illustrated in FIG. 2*a*. The orientation of the antenna in FIG. 2*a* is the same as was used for determining the torque for the antenna mount 10. The center of mass of the antenna and feeds, plus the elevation mounting assembly is at a distance $r_{cm}$ from elevation axis. The elevation motor must provide a torque of $$T_{el}=r_{cm}F_g \sin\theta=r_{cm}mg\sin\theta \quad (2)$$

where m is the mass of the antenna and feeds.

Figure 10:
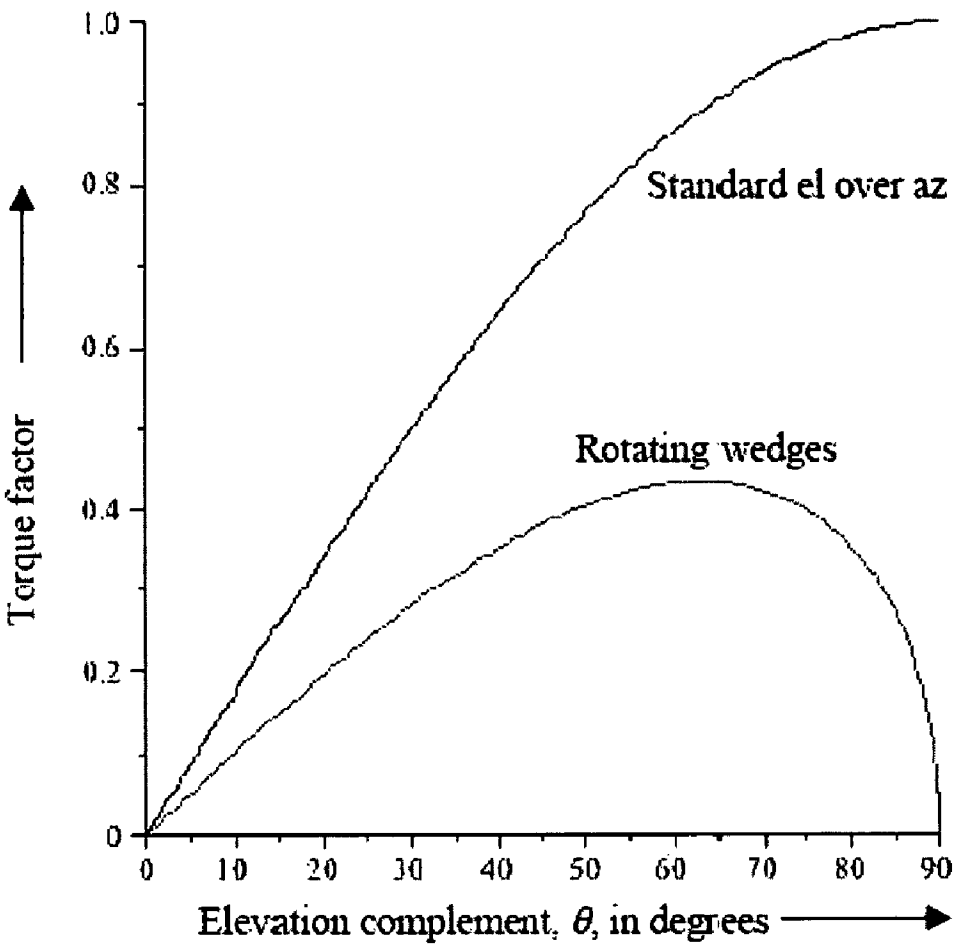
FIG. 10 is a plot of elevation angle vs torque for conventional antenna mounts and the antenna mount of the present invention.

The torque factor for both the mount 10 of the present invention and the standard elevation over azimuth system is plotted in FIG. 10. For the mount 10 of the present invention, the value of the wedge angle $\alpha_{max}=45°$ was chosen. The torque factor is zero for both systems for the elevation complement at $\theta=0°$, i.e., for the antenna pointing at the zenith, and for all other values of elevation angle $\theta$, the torque factor is less for the mount 10 of the present invention, and goes to zero for $\theta=90°$. Overall, the rotating-wedges technique of the present invention requires somewhat less holding torque than the standard elevation-over-azimuth mounts.

Figure 11:
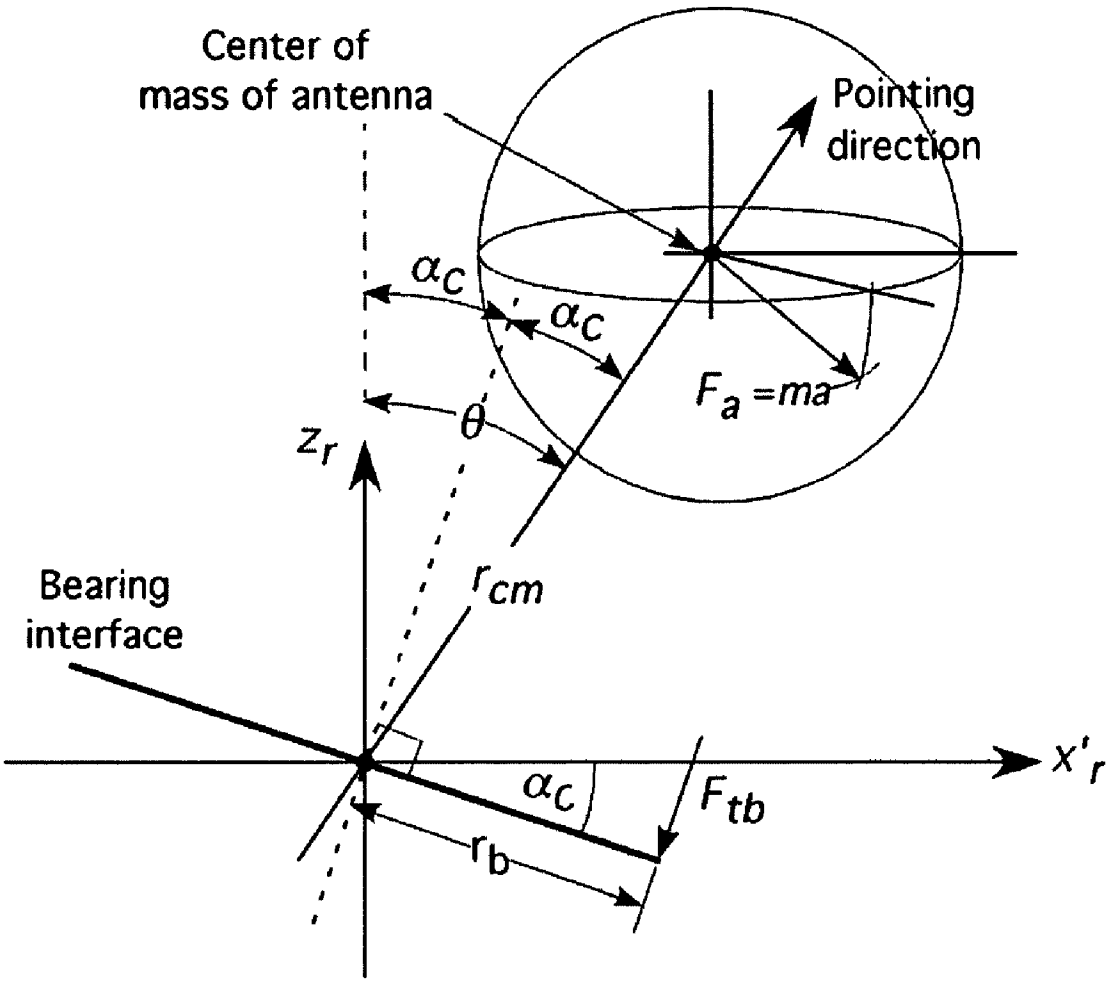
FIG. 11 is a schematic illustration of the factors affecting the torque on an antenna mount with a moving antenna.

Unlike the acceleration due to gravity on a fixed platform, the motion-induced accelerations can be at any angle so that analysis would require extensive work to cover all possibilities. The torque on the bearing structures 21 and 26 arise from an acceleration of magnitude a exerted on the center of mass of the antenna 87, which has a mass m. As illustrated in FIG. 11, the direction in which the acceleration is directed can be anywhere over a sphere. Therefore, the computation becomes much more complex than that for the force of gravity, where the direction of the gravitational force is confined to a plane. It is hypothesized that there is again a torque factor that helps reduce the torque that the motors 24 and 29 must supply. There will likely be zeros and maxima similar to those shown in FIG. 10. Note that the acceleration force can add or subtract from the force of gravity analyzed earlier depending upon the direction of the two forces.

Figures 12A, 12B:
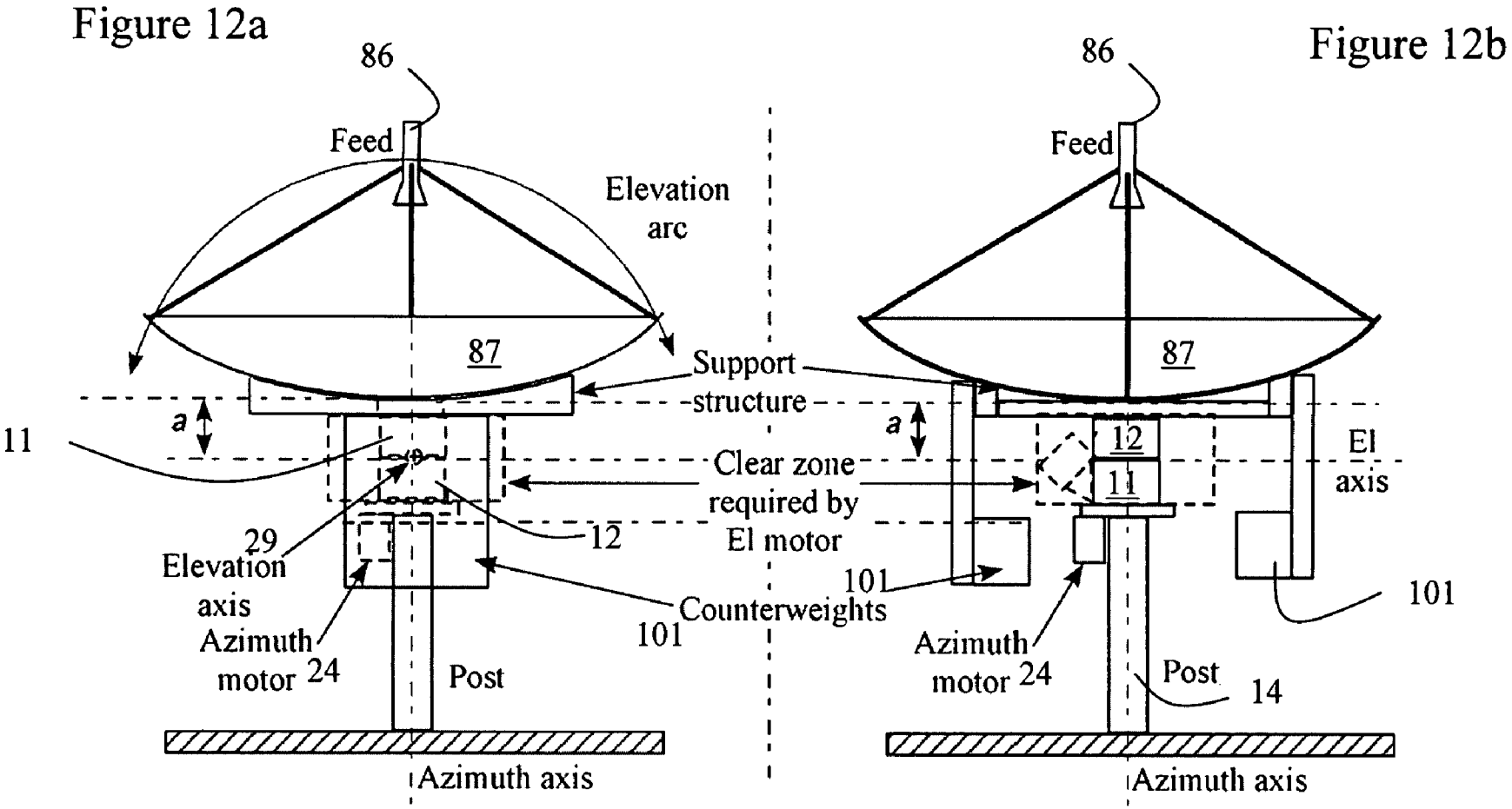
FIG. 12*a* is a side view of an elevation-over-azimuth steering configuration for a 90° elevation angle looking along the elevation axis.
FIG. 12*b* is a side view of an elevation-over-azimuth steering configuration for a 90° elevation angle looking perpendicular to the elevation axis.
Figure 13:
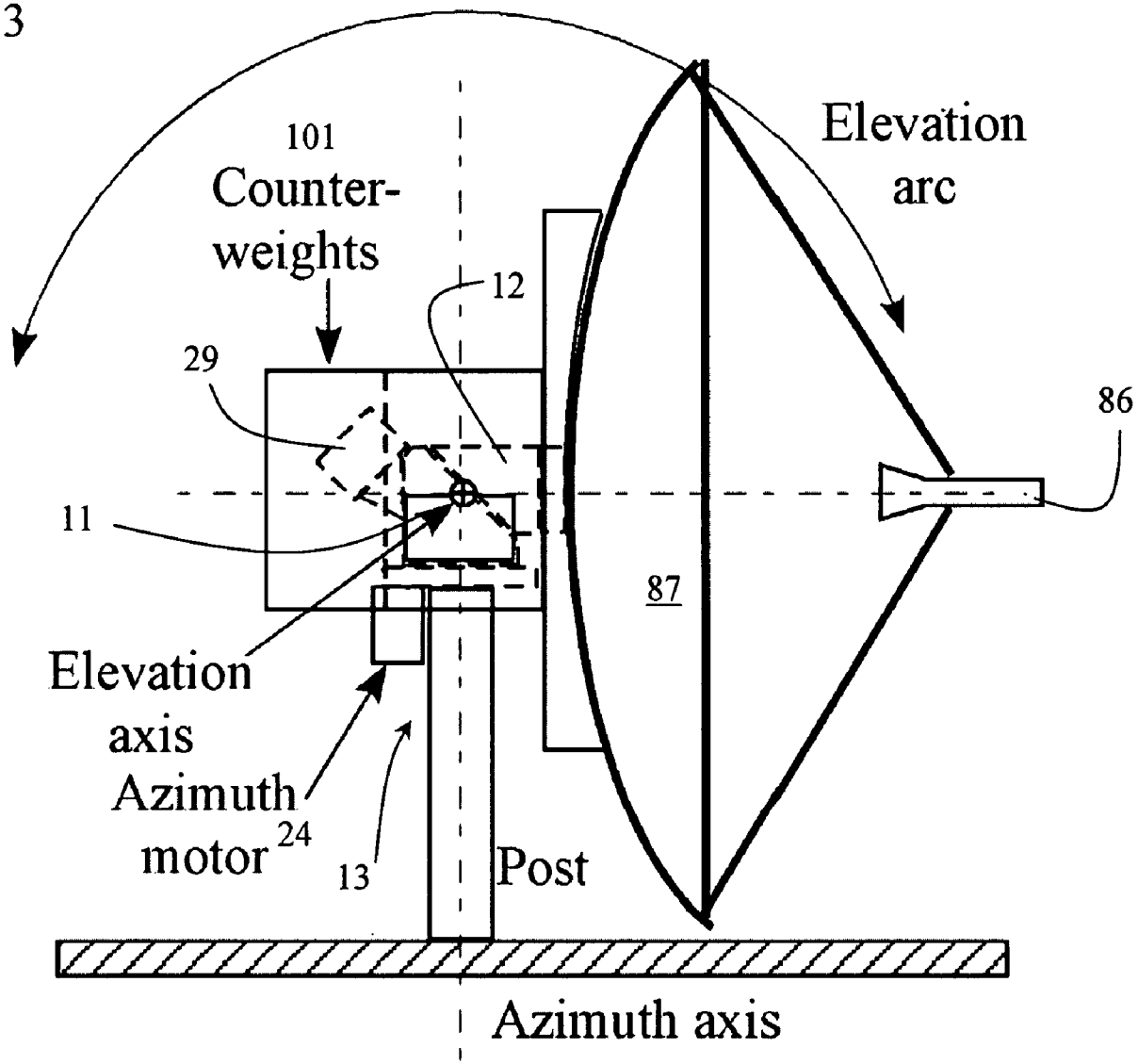
FIG. 13 is a side view of an elevation-over-azimuth steering configuration for a 0° elevation angle looking along the elevation axis.

With reference to FIGS. 12*a*, 12*b* and 13, counterweights 101 can be used to reduce the torque required from the first and second drive motors 24 and 29 in the antenna mount system in accordance with the present invention in an elevation-over-azimuth configuration for full hemispheric coverage. The counterweights 101 hang down to the opposite side of the elevation axis from the antenna structure 87. In FIG. 13, the antenna 87 is positioned to point along the elevation axis to the horizon, whereby the counterweights 101 provide the most counter torque. In principle, the counterbalancing can be implemented so that there is no torque about the elevation axis over the full elevation range and for any roll and pitch of the antenna 87.

In the aforementioned embodiments, the emphasis was primarily on elevation-over-azimuth and cross-elevation-over-elevation stabilized platforms; however, the use of a third axis, i.e. three-axis steering, to compensate for the keyhole effect was mentioned.

In defining the stabilization axes, there are a variety of terms used including the terms azimuth, elevation, and cross-elevation, as hereinbefore defined; however, other terms, such as "level", "cross-level", and "rolling and pitching axes" are sometimes employed. The cross-level angle is "the angle measured about the line of sight, between the vertical plane through the line of sight and the plane perpendicular to the deck through the line of sight", and the "cross-level" and "rolling and pitching axis" are primarily applied to use on ship decks. The term "cross-level" is used when an axis of rotation is added between an azimuth and an elevation axis in accordance with the present invention.

The third axis normally only has a relatively small offset steering capability that is just large enough to move the main two axes away from the keyhole. Another use of a third axis arises primarily in shipboard applications. For example, when a ship borne antenna that is originally pointing straight forward at some elevation angle with the ship level, undergoes a change in alignment due to the ship rolling or pitching a certain amount, it is necessary to find solutions to three-dimensional vector equations in order to determine the new pointing settings for the usual forms of two- or three-axis steering. However, with an antenna mount system with a third, cross-level axis, all that is required is for the cross-level structure to be rotated. Typically, not only are the computations much simpler but more accurate antenna pointing results.

Figure 14:
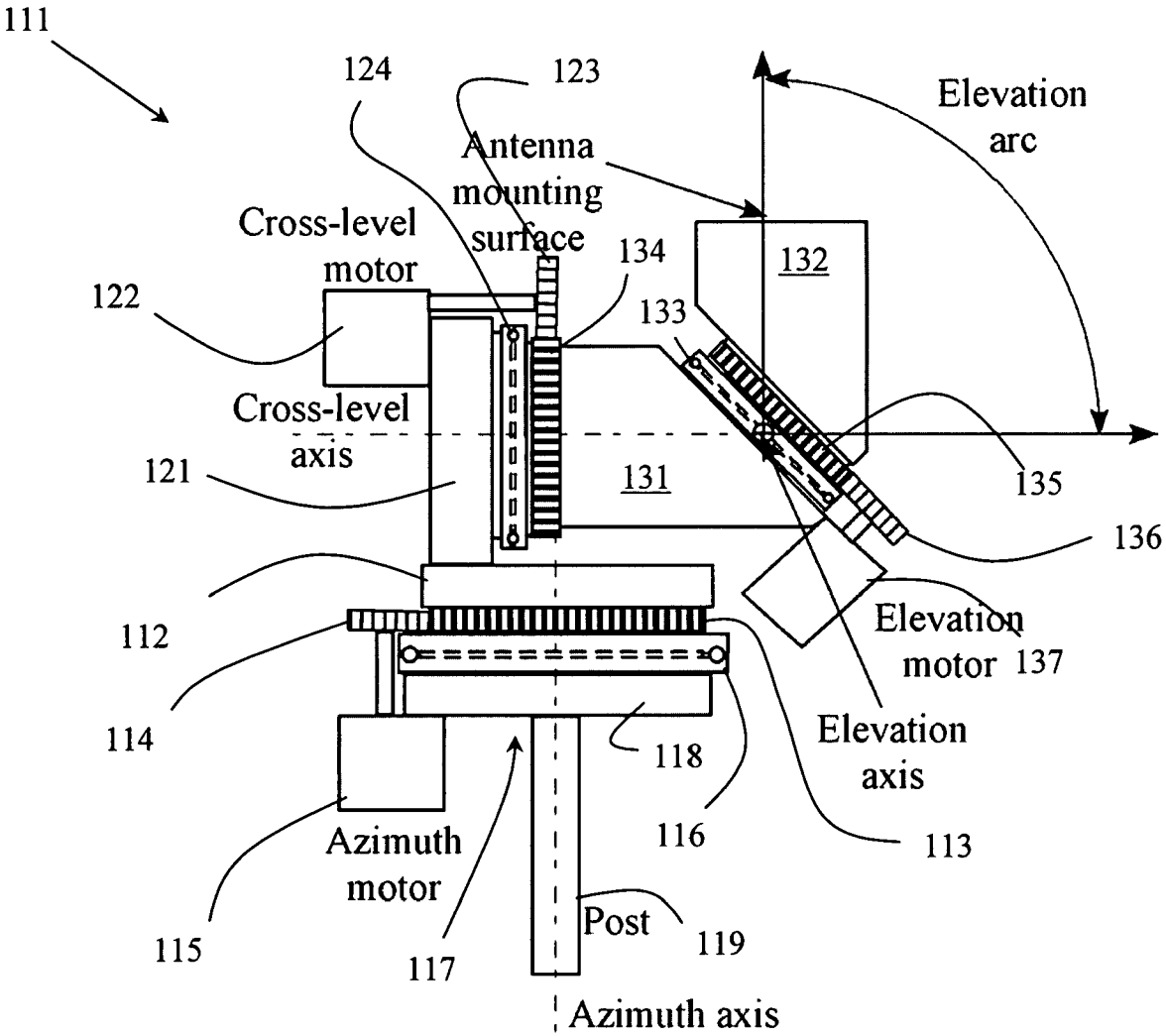
FIG. 14 is an embodiment of an elevation-over-cross-level-over-azimuth antenna mount in accordance with another embodiment of the present invention rotating plates and a single rotating-wedge assembly looking along the azimuth axis with the elevation set to 90°.

For a standard elevation-over-azimuth system, a cross-level axis must be inserted between the elevation and azimuth axes; however, for an antenna mount in accordance with the present invention it is only necessary to use an appropriate combination of rotating wedge pairs and rotating plates. For example, to perform the functions of a three-axes system an antenna mount 111, illustrated in FIG. 14, comprising three sub-assemblies can be used. The first sub-assembly comprises a first rotating plate 112 for the azimuth steering about the azimuth (vertical) axis. The rotating plate 112 includes a circular rack gear 113 extending outwardly from around the bottom thereof for engaging a spur gear 114, which is driven by an azimuth motor 115. A bearing structure 116, including opposed bearing surfaces with some form of bearing material therebetween, is mounted on a supporting structure 117, which includes a horizontal plate 118 and a vertical post 119. The supporting structure 117 also supports the azimuth motor 115. The bearing structure 116 enables the rotating plate 112 to rotate relative to the supporting structure 117 about a first, e.g. vertical or azimuth, axis when the azimuth motor 115 is engaged to drive the spur gear 114 and the rack gear 113.

The second sub-assembly comprises a second rotating plate 121 extending from and perpendicular to the plane of the first rotating plate 112 for the cross-level steering. A cross-level motor 122 is mounted on the rotating plate 121 for driving a spur gear 123. A second bearing structure 124 is mounted on the second rotating plate 121 for rotating the wedge pair, hereinafter described, about a horizontal cross-level axis, which is perpendicular to the first axis.

The third sub-assembly comprises first and second wedges 131 and 132 with a third bearing structure 133 therebetween. The first wedge 131 includes a rack gear 134 extending around one end thereof for engaging the second spur gear 123. The second wedge 132 includes a rack gear 135 extending around one end thereof for engaging a third spur gear 136, which is driven by an elevation motor 137 mounted on the first wedge 131.

As above, the wedge angles ideally vary between 20° and 45°; however, when the wedge angle are different, the range of wedge angles can vary between 20° and 70°, and typically add up to between 40° and 90°.

The cross-level motor 122 is used to perform the cross-level steering, and, in combination with the elevation motor 137, is used to perform the elevation steering. In principle, this pointing system could be mounted upon a fixed post 119 with all the moving mechanisms clustered together near the back of the antenna (not shown). With the configuration illustrated in FIG. 14, the range of elevation steering need not be much more that the 90° to 0°. Full hemispheric coverage is achieved by appropriate azimuth steering provided by the first sub-assembly. In some special applications, a fourth steering axis is provided by either an additional rotating-wedge pair, or an additional rotating disk.

We claim:

1. An antenna mount comprising:

a base;

a first bearing structure supported by the base;

a first wedge-shaped body having a first end mounted on the first bearing structure and a second end at a first acute wedge angle to the first end;

a second bearing structure mounted on the second end of the first wedge-shaped body;

a second wedge-shaped body mounted on the second bearing structure, having a first end parallel to the second end of the first wedge-shaped body and a second end at a second acute wedge angle to the first end of the second wedge-shaped body;

a first motor for rotating the first wedge-shaped body relative to the base; and a second motor for rotating the second wedge-shaped body relative to the first wedge-shaped body.

2. The antenna mount according to claim 1, wherein the first acute wedge angle is between 20° and 70°.

3. The antenna mount according to claim 1, wherein the first and second acute wedge angles are equal, and between 25° and 45°.

4. The antenna mount according to claim 2, wherein the first and second acute wedge angles add up to a combined angle between 40° and 90°.

5. The antenna mount according to claim 1, further comprising;

a third wedge-shaped body having a first end parallel to the second end of the second wedge-shaped body and a second end at a third acute wedge angle to the first end of the third wedge-shaped body;

a third bearing structure between the second and third wedge-shaped bodies; and a third motor for rotating the third wedge-shaped body relative to the second wedge-shaped body.

6. The antenna mount according to claim 1, further comprising:

a third bearing structure mounted on the second end of the second wedge-shaped body;

a third wedge-shaped body having a first end mounted on the third bearing structure, and a second end at a third acute wedge angle to the first end of the third wedge-shaped body;

a third motor for rotating the third wedge-shaped body relative to the second wedge-shaped body;

a fourth wedge-shaped body having a first end parallel to the second end of the third wedge-shaped body and a second end at a third acute wedge angle to the first end of the fourth wedge-shaped body;

a fourth bearing structure between the third and fourth wedge-shaped bodies; and a fourth motor for rotating the fourth wedge-shaped body relative to the third wedge-shaped body.

7. The antenna mount according to claim 6, further comprising an antenna mounted on the second end of the fourth wedge-shaped body.

8. The antenna mount according to claim 1, further comprising:

a third wedge-shaped body having a first end mounted on the base, and a second end at a third acute wedge angle to the first end of the third wedge-shaped body;

a third bearing structure between the base and the first end of the third wedge-shaped body;

a fourth wedge-shaped body having a first end parallel to the second end of the third wedge-shaped body and a second end at a third acute wedge angle to the first end of the fourth wedge-shaped body;

a fourth bearing structure between the third and fourth wedge-shaped bodies; and a third motor for rotating the third and fourth wedge-shaped bodies relative to the base.

9. The antenna mount according to claim 8, further comprising an antenna mounted on the second end of the second wedge-shaped body.

10. The antenna mount according to claim 1, further comprising:

an electrical slip ring mounted between the base and the first wedge-shaped body;

a first power cord extending through the base to the electrical slip ring; and a second power cord extending from the electrical slip ring through the first wedge-shaped body to the second motor.

11. The antenna according to claim 1, further comprising:

an antenna mounted on the second wedge-shaped body for transmitting and/or receiving signals;

an signal control center mounted adjacent to the antenna for processing the signals received or transmitted by the antenna;

an electrical slip ring mounted between the base and the first wedge-shaped body;

a first power cord extending through the base to the electrical slip ring; and a second power cord extending from the electrical slip ring through the first and second wedge-shaped bodies to the second motor.

12. The antenna according to claim 1, further comprising:

an antenna mounted on the second wedge-shaped body for transmitting and/or receiving signals;

an signal control center mounted remote from the antenna for processing the signals received or transmitted by the antenna;

an rotary joint mounted between the base and the first wedge-shaped body;

a data cable extending from the signal control center, through the base to the rotary joint; and a second data cable extending from the rotary joint through the first and second wedge-shaped bodies to the antenna.

13. The antenna according to claim 1, further comprising:

an antenna mounted on the second wedge-shaped body for transmitting and/or receiving signals, the antenna having a center of gravity rotatable about an elevation axis; and counter weights extending from the antenna on an opposite side of the elevation axis to the antenna's center of gravity to reduce the torque required from the first and second motors.

14. The antenna mount according to claim 1, further comprising:

a first rotating body rotatably mounted on the base about a first axis;

a third bearing structure between the base and the first rotating body;

a third motor for rotating the first rotating body relative to the base;

wherein the first wedge-shaped body is rotatably mounted on the first rotating body via the first bearing structure about a second axis perpendicular to the first axis.

* * * * *

UNITED STATES PATENT AND TRADEMARK OFFICE

CERTIFICATE OF CORRECTION

PATENT NO. : 8,059,048 B2
APPLICATION NO. : 12/396520
DATED : November 15, 2011
INVENTOR(S) : Felstead et al.

It is certified that error appears in the above-identified patent and that said Letters Patent is hereby corrected as shown below:

Col. 2, line 50, "can be use." should read -- can be used. --

Col. 2, line 52, "be slightly extend." should read -- be slightly extended. --

Col. 3, line 12, "abase" should read -- a base --

Col. 5, line 43, "as seen in 6)." should read -- as seen in FIG. 6). --

Col. 5, line 50, "a dashed line in 4," should read -- a dashed line in FIG. 4, --

Col. 5, line 53: "mutation." should read -- nutation. --

Col. 6, line 48, "for the example in 5" should read -- for the example in FIG. 6 --

Col. 9, line 32, "$T_{el} = r_{cm}F_g \sin\theta = r_{cm}mg \sin\theta$ (2)"
should read -- $T_{el} = r_{cm}F_g \sin\theta = r_{cm}mg \sin\theta$ --

Col. 9, line 33, "where m is the mass of the antenna and feeds." should read -- where m is the mass of the antenna and feeds, $F_g$ is the force of gravity and g is the acceleration due to gravity. --

Col. 11, lines 9 and 10, "As above, the wedge angles ideally vary between 20° and 45°; however, when the wedge angle are different," should read -- As above, the two wedge angles are equal and ideally vary between 20° and 45°; however, when the wedge angles are different, --

Signed and Sealed this
Third Day of July, 2012

David J. Kappos

David J. Kappos
*Director of the United States Patent and Trademark Office*